United States Patent [19]

Palma

[11] Patent Number: 4,936,061

[45] Date of Patent: Jun. 26, 1990

[54] GUTTER AND SCREEN ORGANIZATION

[76] Inventor: John S. Palma, 15 Pitcairn Dr., Roseland, N.J. 07068

[21] Appl. No.: 360,050

[22] Filed: Jun. 1, 1989

[51] Int. Cl.[5] ..... E04O 13/06

[52] U.S. Cl. ..... 52/12; 52/11

[58] Field of Search ..... 52/11, 12, 13, 14, 15, 52/16

[56] References Cited

U.S. PATENT DOCUMENTS 3,550,381 12/1970 South ..... 52/12

4,553,356 11/1985 Pepper ..... 52/11

*Primary Examiner*—Michael Safavi

*Attorney, Agent, or Firm*—Leon Gilden

[57] ABSTRACT

A gutter and screen organization is set forth utilizing an elongate gutter defining a channel therewithin provided with a forward wall with an inwardly directed flange and an opposed rear wall with a forwardly directed flange wherein the forward and rearward flanges are directed interiorly of the gutter. A series of forward tabs are formed through the forward and flange hingedly secured to the flange at a rearwardmost end of the tabs with a forward arcuate nose of each tab minimizing harm to a user of the device. A mesh screen of a width substantially equal to that defined between the forward and rear walls overlies the flanges to enable penetration of the forward tabs through openings of the screen. Optionally, tabs are formed on the rear flange to further assist in securement of the screen to the gutter. A modification of the instant invention utilizes a deformable spherical tip formed to a stem to receive the mesh screen thereon.

11 Claims, 1 Drawing Sheet

FIG. 1
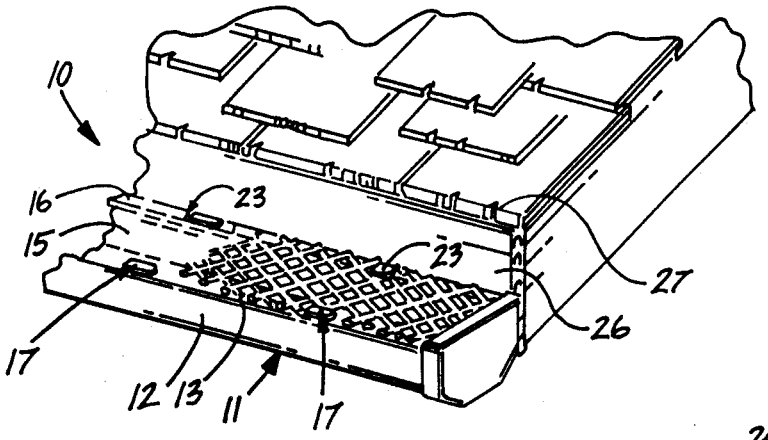
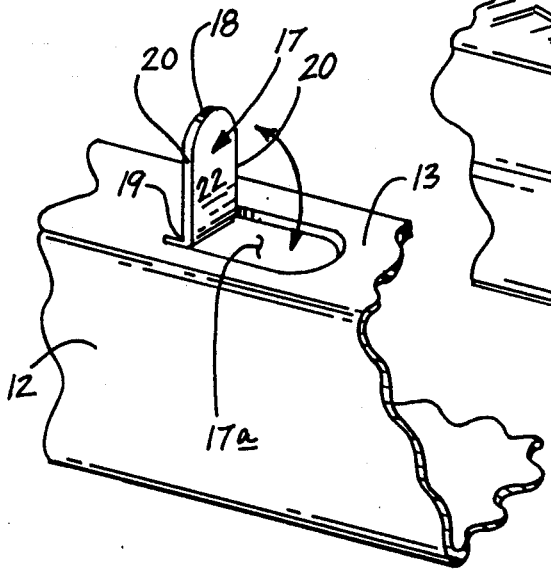
FIG. 2
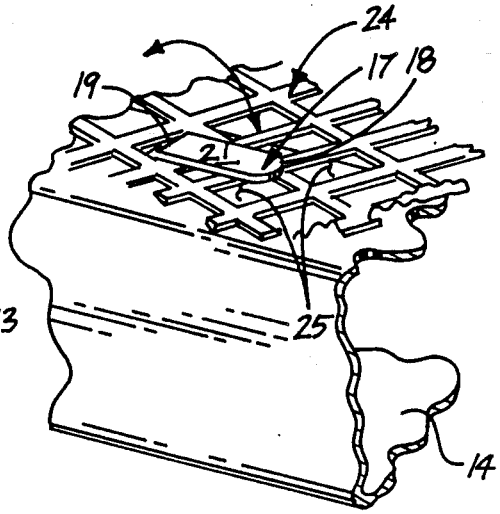
FIG. 3
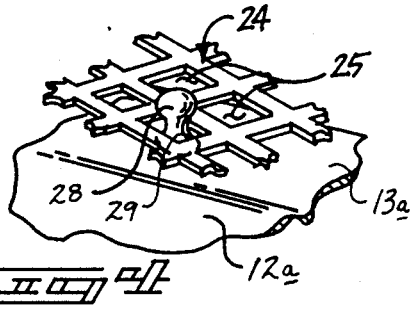
FIG. 4

GUTTER AND SCREEN ORGANIZATION

BACKGROUND OF THE INVENTION

1. Field of the Invention

The field of invention relates to gutters and protective devices therefore, and more particularly pertains to a new and improved gutter and screen organization wherein the screen is selectively securable in interlocking engagement with the inwardly directed forward flange of the gutter. Optionally, the screen may engage both forward and rear flanges.

2. Description of the Prior Art

The use of gutter guards of various types and complexities have been set forth in the prior art. The prior art has utilized relatively complex organizations for securement of an associated screen to a gutter. The instant organization attempts to overcome deficiencies of the prior art by providing an organization enabling rapid, safe and economical securement of the screen to an associated gutter. Examples of prior art devices include U.S. Pat. No. 2,948,083 to Steele providing a series of tabs for securement overlying a forward flange of a gutter to secure an elongate mesh screen to the gutter.

U.S. Pat. No. 3,053,393 to McLean utilizes an overlying combination screen and clip for resiliently securing an elongate screen portion to a gutter.

U.S. Pat. No. 3,420,378 to Turner sets forth a gutter provided with a screen that is formed with forwardly mounted hinges to normally bias the screen in a downward orientation relative to the gutter.

U.S. Pat. No. 3,067,881 to Goosmann sets forth an elongate screen provided with a series of clips to secure the screen fixedly to the gutter by utilizing spring clips that engage about the forward outwardly turned seam of the gutter.

U.S. Pat. No. 2,636,458 to Harris sets forth a conventional elongate gutter provided with a sectionalized convering that is secured to the gutter utilizing a series of spring clips to secure the screen to forward and rear portions of the gutter.

U.S. Pat. No. 2,365,845 to Schweda utilizes a generally "S" shaped flange coextensively formed with the screen to enable securement of the screen to a forward lip of the associated gutter.

U.S. Pat. No. 453,948 to Smith sets forth a screen provided with a curved forward end for encompassing a forward outwardly turned flange of an associated gutter to resiliently engage the gutter and maintain the screen in contact with the gutter in use.

U.S. Pat. No. 3,436,878 to Singer utilizes an elongate rigid covering overlying a gutter which includes fasteners to secure the rearward portion of the covering to a support surface underlying an eave with a forward "U" shaped flange overlying the forward top surface of the gutter.

U.S. Pat. No. 3,834,091 to Dugan sets forth a screen provided with a series of clips to secure the screen to the forward elongate edge of the gutter.

U.S. Pat. No. 4,467,570 to Krigel sets forth a screen provided with integral and separable tabs to be secured along a forward edge of the screen to a forward flange of the associated gutter.

As such, it may be appreciated that there is a continuing need for a new and improved gutter and screen guard wherein the same addresses both the problems of ease of use, effectiveness of construction and economy, and in this respect, the present invention substantially fulfills this need.

SUMMARY OF THE INVENTION

In view of the foregoing disadvantages inherent in the known types of gutter and screen organizations now present in the prior art, the present invention provides a gutter and screen organization wherein the same may be readily and effectively secured overlying inwardly directed flanges of an associated gutter by hingedly mounted tabs formed from the flanges of the gutter. As such, the general purpose of the present invention, which will be described subsequently in greater detail, is to provide a new and improved gutter and screen organization which has all the advantages of the prior art gutter and screen protective devices and none of the disadvantages.

To attain this, the present invention comprises an elongate gutter defining a channel with an inwardly directed forward flange and an optional rear elongate rear flange defining uppermost surfaces of the gutter wherein the forward flange is provided with die cut tabs formed therefrom which are recessed with and a aligned with the forward flange in a first position and directed orthogonally relative to the forward flange in a second position to receive a mesh screen covering and in a third position secure the screen in contiguous contact with the forward flange. Optionally, a series of rear tabs may be formed within the rear flange aligned with the forward flange to ease alignment and securement of the covering screen relative to the gutter. The tabs are formed with arcuate forward noses minimizing accidental injury to a user of the organization. A modification of the invention utilizes a spaced series of deformable spheres integrally formed at upper ends of steps that are in turn orthogonally and integrally secured to the forward and/or rear gutter flanges to receive the mesh screen thereover. The spheres are of a diameter greater than the narrowest dimension of the mesh screen to prevent displacement of the screen once positioned on the gutter arrangement.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved gutter and screen organization which has all the advantages of the prior art gutter and screen protective devices and none of the disadvantages.

It is another object of the present invention to provide a new and improved gutter and screen organization which may be easily and efficiently manufactured and marketed.

It is a further object of the present invention to provide a new and improved gutter and screen organization which is of a durable and reliable construction.

An even further object of the present invention is to provide a new and improved gutter and screen organization which is susceptible of a low cost of manufacture with regard to both materials and labor, and which accordingly is then susceptible of low prices of sale to the consuming public, thereby making such gutter and screen organizations economically available to the buying public.

Still yet another object of the present invention is to provide a new and improved gutter and screen organization which provides in the apparatuses and methods of the prior art some of the advantages thereof, while simultaneously overcoming some of the disadvantages normally associated therewith.

Still another object of the present invention is to provide a new and improved gutter and screen organization wherein the same utilizes integral tabs formed to a flange portion of an elongate gutter to receive and secure an associated screen in contact with the flange.

It is a further object to facilitate the selective installation of a protective screen, whether it be inside corners, outside corners or the full length of the gutter without excessive and involved waste.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is an isometric illustration of the instant invention.

FIG. 2 is an isometric illustration of the instant invention with a forward tab in a second position.

FIG. 3 is an isometric illustration of the instant invention with a forward tab in third position.

FIG. 4 is an isometric illustration of a modification of the instant invention.

DESCRIPTION OF THE PREFERRED EMBODIMENT

With reference now to the drawings, and in particular to FIGS. 1 to 3 thereof, a new and improved gutter and screen organization embodying the principles and concepts of the present invention and generally designated by the reference numeral 10 will be described.

More specifically, it will be noted that the gutter and screen organization 10 essentially comprises an elongate gutter 11 defining a channel interiorly thereof. Gutters of this class are typically formed of extruded rigid material and may be metallic or of polymeric construction. The gutter 11 includes a forward wall 12 with an inwardly directed forward flange 13. The forward wall 12 is secured to an underlying floor 14 which is in turn integrally formed to a rear wall 15 spaced generally parallel to the forward wall 12. The rear wall 15 is formed with an integrally inwardly directed rear flange 16. The forward and rear flanges 13 and 16 respectively include upper surfaces which are aligned and coplanar with one another and coextensively formed along the forward and rear walls 12 and 15 respectively.

A series of first tabs 17 are formed orthogonally through the forward flange 13 and are aligned with one another along the flange. The tabs 17 are spaced at intervals at eight to twenty inches with twelve inches being optimum to secure an associated screen with a minimum of tabs. The tabs 17 are preferably die cut through the flange and are thereby aligned with the flange in a first position as they are accepted within a complementary opening 17*a*. The tabs 17 are hingedly mounted at a rear edge 19 and integrally secured thereto to the channel 13 and include spaced parallel sides 20 defining an arcuate forward surface 18. The arcuate forward surface minimizes damage to an associated screen to be secured to the gutter 11 and futher minimizes injury to a user of the instant invention. The tabs include a top face 21 and a bottom face 22 spaced parallel to one another. Optionally, a series of second tabs 23 aligned with the first tabs 17 may be formed through the rear flange 16 and of equal dimensional configuration and orientation as the first tabs 17 wherein for purposes of illustration, only the detail of the first tabs 17 need be illustrated.

A mesh screen 24 of a length coextensive with the length of the gutter 11 is provided and is of a width substantially equal to the width defined between the forward wall 12 and the rear wall 15 to be received upon the upper surfaces of the forward flange 13 and the rear flange 16. The mesh screen 24 is provided with a matrix of openings 25 to enable the upwardly projecting tabs 17 and 23 to be received through the openings. It is understood that in the event second tabs 23 are formed through the rear flange 16, their spacing is equal to that of the first tabs 17 and aligned therewith to provide ease of projection of the tabs through the associated screen 24 as the openings of the screen 24 are alignated where in offset of such tabs may create misalignment of the screen and a skewing of the screen if the openings and the tabs are not oriented properly relative to one another. The tabs, as illustrated in FIG. 2, are in a second position to enable the screen 24 to be directed thereover and are illustrated in a final third position in FIG. 3 with the bottom surface 22 of the first tab 17 capturing the screen 24 between the upper surface of the forward flange 14 and the bottom surface 22. The capturing of the screen 24 by use of optional rear tabs 23 would clearly be indentical in integral securement of the screen 24 relative to the upper surface of the rear flange 16. The organization 10 is securable against a support surface 26 underlying an eave 27 of a conventional roof.

FIG. 4 is illustrative of a modification 10*a*of the instant invention particularly when applied to polymeric gutter constructions. A spaced series of deformable spherical bulbs 28 are integrally formed to an upper end of a stem 29 integrally and orthogonally affixed to forward flange 13*a* of the forward wall 12*a* to receive the screen 24 by directing the bulb 28 through a screen opening 25. The bulb 25 is of a nominal diameter greater than a narrowest dimension defined by a width of the openings 25 to prevent inadvertent removal or displacement of the screen 24 subsequent to its assembly overlying flange 13*a*. The stem 29 is of a height substantially equal to the thickness of the screen 25. It is understood that optionally the spherical bulb and stem assembly may also be positioned onto the rear flange of the gutter in a spacing similarly to that depicted in FIG. 1.

As to the manner of usage and operation of the instant invention, the same should be apparent from the above disclosure and accordingly no further discussion relative to the manner of usage and operation shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by letters patent of the United States is as follows:

1. A gutter and screen organization comprising, in combination, an elongate gutter including a forward wall with an integral coextensive forward flange integrally formed to an upper end of the forward wall and directed interiorly of said gutter, and a floor formed to said forward wall and a rear wall spaced from said forward wall with a rear flange coextensively formed and directed interiorly of said gutter and formed to an upper end of said rear wall, and a mesh screen formed with a matrix of openings wherein the screen is of a length substantially equal to that of the gutter and of a width substantially equal to the spacing between the upper ends of the rear and forward walls, and securement means integrally formed to the forward flange for securement of the screen to an upper surface of the forward flange, and wherein the securement means comprises a series of first elongate tabs integrally and pivotally formed at a rear end of each tab to the forward flange.

2. A gutter and screen organization as set forth in claim 1 wherein each of the first tabs is aligned with one another and is pivotally mounted at a rear edge of each tab to the forward flange and of a thickness substantially equal to that of the forward flange.

3. A gutter and screen organization as set forth in claim 2 wherein each of the first tabs is received within a respective first opening of a complementary configuration to each of the first tabs.

4. A gutter and screen organization as set forth in claim 3 wherein a forward surface of each tab is arcuate to provide a deflecting surface to minimize injury to the screen for an individual utilizing the gutter and screen organization.

5. A gutter and screen organization as set forth in claim 4 wherein the securement means further includes a series of second tabs integrally and pivotally formed to the rear flange wherein each of the second tabs is in alignment with a respective first tab and of a substantially equal configuration to that of the first tabs and received within a respective second opening within the rear flange.

6. A gutter and screen organization as set forth in claim 5 wherein each of the first and second tabs are pivotal from a first position coextensive with the surface of the respective forward and rear flanges and pivotal to a second position orthogonally oriented relative to the respective first and second flanges, and pivotal to a third position capturing the screen between a bottom surface of the respective first and second tabs and an upper surface of the respective forward and rear flanges.

7. A gutter and screen organization as set forth in claim 6 wherein upper surfaces of the forward and rear flanges are in alignment and coplanar with one another.

8. A gutter and screen organization comprising, in combination, an elongate gutter including a forward wall with an integral coextensive forward flange integrally formed to an upper end of the forward wall and directed interiorly of said gutter, and a floor formed to said forward wall and a rear wall spaced from said forward wall with a rear flange coextensively formed and directed interiorly of said gutter and formed to an upper end of said rear wall, and a mesh screen formed with a matrix of openings wherein the screen is of a length substantially equal to that of the gutter and of a width substantially equal to the spacing between the upper ends of the rear and forward walls, and securement means integrally formed to the forward flange for securement of the screen to an upper surface of the forward flange, and wherein the securement means comprise a series of spaced spherical bulbs fixedly secured to upper terminal ends of stems, said stems are orthogonally and fixedly secured to an upper surface of said forward flange.

9. A gutter and screen organization as set forth in claim 8 wherein a diameter defined by said bulbs are greater than a width dimension defined by said openings.

10. A gutter and screen organization as set forth in claim 9 wherein said bulbs are deformable.

11. A gutter and screen organization as set forth in claim 10 wherein said stems are of a predetermined height substantially equal to a thickness defined by said screen.

* * * * *